US011965410B2

(12) United States Patent
Kabi et al.

(10) Patent No.: US 11,965,410 B2
(45) Date of Patent: Apr. 23, 2024

(54) ORCHESTRATION FRAMEWORK TO DETERMINE COMPOSITE WELL CONSTRUCTION RECOMMENDATIONS

(71) Applicant: Halliburton Energy Services, Inc., Houston, TX (US)

(72) Inventors: Bibek Kabi, Bangalore (IN); Julien Christian Marck, Houston, TX (US); Olivier Roger Germain, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 38 days.

(21) Appl. No.: 17/889,960

(22) Filed: Aug. 17, 2022

(65) Prior Publication Data

US 2024/0060413 A1 Feb. 22, 2024

(51) Int. Cl.
*E21B 47/00* (2012.01)

(52) U.S. Cl.
CPC ..... *E21B 47/00* (2013.01); *E21B 2200/20* (2020.05); *E21B 2200/22* (2020.05)

(58) Field of Classification Search
CPC ... E21B 47/00; E21B 2200/20; E21B 2200/22
(Continued)

(56) References Cited

U.S. PATENT DOCUMENTS 10,400,573 B2 * 9/2019 Yang ..... E21B 7/06
2004/0256152 A1 12/2004 Dashevskiy et al.
(Continued)

FOREIGN PATENT DOCUMENTS

WO 2009058635 A2 5/2009
WO 2011016927 A1 2/2011

OTHER PUBLICATIONS

Al Dushaishi, Mohammed F., et al. "Selecting optimum drilling parameters by incorporating vibration and drilling efficiency models." SPE/IADC Drilling Conference and Exhibition. SPE, 2016. (Year: 2016).*

(Continued)

*Primary Examiner* — John E Johansen
(74) *Attorney, Agent, or Firm* — Michael Jenney; Parker Justiss, P.C.

(57) ABSTRACT

The disclosure presents processes to determine one or more recommendations to well construction operations, generated by analyzing impacts on well construction operations. The impacts can include impacts to the drilling assembly, impacts of the subterranean formation characteristics, impacts on cost, time and performance of the well construction operation, impacts on the service quality, impacts to system integrity, impacts to surface equipment, as well as other impact types, such as geological surveys, seismic surveys, stratigraphic analysis, or reservoir estimations. Each impact can be analyzed using an impact parameter and a softness parameter. An impact map can be computed for each of the parameters, and then the impact maps can be combined to compute one or more integrated impact maps from which the recommendations can be determined. The recommendations can be communicated to a well construction system, such as a geo-steering system, a user system, a well site controller, or other systems.

21 Claims, 12 Drawing Sheets

(58) Field of Classification Search
USPC ..... 703/10
See application file for complete search history.

(56) References Cited

U.S. PATENT DOCUMENTS

| | | | | |
|---|---|---|---|---|
| 2012/0118637 | A1 | 5/2012 | Wang et al. | |
| 2013/0066445 | A1 | 3/2013 | Wang et al. | |
| 2019/0345809 | A1 | 11/2019 | Jain et al. | |
| 2023/0367613 | A1* | 11/2023 | Saraiya | G06F 16/9017 |

OTHER PUBLICATIONS

Ranieri, A., P. Perez, and T. Muniz. "Integrating Safety Management Practices To Manage Operational Risks of Multiple Contractors in Offshore Drilling Ventures." SPE Latin American and Caribbean Health, Safety, Environment, and Sustainability Symposium. SPE, 2013. (Year: 2013).*

Zagayevskiy, Yevgeniy, and Clayton V. Deutsch. "Impact Map for Assessment of New Delineation-Well Locations." Journal of Canadian Petroleum Technology 52.06 (2013): 441-462. (Year: 2013).*

Payette, et al.; "A Real-Time Well-Site Based Surveillance and Optimization Platform for Drilling: Technology, Basic Workflows and Field Results"; IADC; SPE International; Society of Petroleum Engineers; SPE/IADC-184615-MS; SPE/IADC Drilling Conference and Exhibition; Mar. 14-16, 2017; 19 pgs.

Christian; "Identifying the Optimum Zone for Reducing Drill String Vibrations"; SPE International; Society of Petroleum Engineers; SPE-189284-STU; SPE International Student Paper Contest at the SPE Annual Technical Conference and Exhibition; Oct. 9-11, 2017; 12 pgs.

Dupriest; "Comprehensive Drill-Rate Management Process To Maximize Rate of Penetration"; SPE International; SPE 102210; SPE Annual Technical Conference and Exhibition; Sep. 24-27, 2006; 9 pgs.

* cited by examiner

ORCHESTRATION FRAMEWORK TO DETERMINE COMPOSITE WELL CONSTRUCTION RECOMMENDATIONS

TECHNICAL FIELD

This application is directed, in general, to developing a drilling plan for drilling through a subterranean formation and, more specifically, to determining one or more recommendations for the drilling plan.

BACKGROUND

In developing a borehole, such as for hydrocarbon production, scientific purposes, or other purposes, it can be important to know the relative risks for executing a drilling operation plan. Risks can impact various aspects of the drilling operation, such as the drilling assembly, the bit life, or the integrity of the drilling system. There can be impacts on the legal contract and liabilities therein (violation of legal contract requires management of change). There can be impacts on the performance, time, or cost of the drilling operation. There can be subterranean formation impacts, such as knowing the rock characteristics, identifying the relative location of nearby water or hydrocarbon reservoirs, knowing where the stratigraphic layers are, and other subterranean formation characteristics. There can be other impacts, such as on the rig and its equipment and systems. Within the oil and gas sector, many industry players have developed different digital advisors that provide recommendations in real-time to mitigate different risks. It would be beneficial to understand how the various risks impact drilling operations and what recommendations can be derived in real-time to direct future drilling operations by utilizing the advice from multiple digital advisors.

SUMMARY

In one aspect, a method is disclosed. In one embodiment, the method, includes (1) receiving input parameters for a location within a borehole, wherein the input parameters include input recommendations for a set of drilling parameters from more than one digital advisor, a respective impact parameter and softness parameter for each drilling parameter in the set of drilling parameters, subterranean formation parameters near the location, and characteristics and parameters of a drilling assembly utilized within the borehole, (2) generating a set of impact maps utilizing the input parameters, wherein each impact map in the set of impact maps is a correlation of an impact severity level with a drilling parameter in the set of drilling parameters, and the correlation utilizes at least one impact value and one softness value for the drilling parameter, (3) computing an integrated impact map utilizing the set of impact maps and a determined integration algorithm, and (4) determining one or more drilling recommendations utilizing the set of impact maps, and the input parameters, wherein the one or more drilling recommendations specify at least one of a safe operating zone, an intermediate zone, or a no-go zone.

In a second aspect, a system is disclosed. In one embodiment, the system, includes (1) a data transceiver, capable of receiving input parameters for a location within a borehole, wherein the input parameters include one or more recommendations used to determine drilling parameters from various digital advisors in real-time or near real-time, subterranean formation parameters near the location, drilling parameters, characteristics and parameters of a drilling assembly utilized within the borehole, or impact values and softness values corresponding to the drilling parameters, and (2) an impact processor, capable of communicating with the data transceiver, generating one or more impact maps utilizing the input parameters, computing an integrated impact map utilizing the one or more impact maps, and determining one or more drilling recommendations utilizing the integrated impact map, the one or more impact maps, and the input parameters, wherein, the one or more impact maps is a correlation of an impact severity level and the drilling parameters, and the correlation utilizes at least one impact value and one softness value for each drilling parameter, and the one or more drilling recommendations specify a safe operating zone, a no-go zone, or an intermediate zone for the drilling parameters.

In a third aspect, a computer program product having a series of operating instructions stored on a non-transitory computer-readable medium that directs a data processing apparatus when executed thereby to perform operations to determine one or more drilling recommendations is disclosed. In one embodiment, the operations include (1) receiving input parameters for a location within a borehole, wherein the input parameters at least include input recommendations for a set of drilling parameters from more than one digital advisor, (2) generating a set of impact maps utilizing the input parameters, wherein each impact map in the set of impact maps is a correlation of an impact severity level with a drilling parameter in the set of drilling parameters, and the correlation utilizes at least one impact value and one softness value for the drilling parameter, (3) computing an integrated impact map utilizing the set of impact maps and a determined integration algorithm, and (4) determining the one or more drilling recommendations utilizing the set of impact maps, and the input parameters, wherein the one or more drilling recommendations specify at least one of a safe operating zone, an intermediate zone, or a no-go zone.

BRIEF DESCRIPTION

Reference is now made to the following descriptions taken in conjunction with the accompanying drawings, in which.

DETAILED DESCRIPTION

Figure 1:
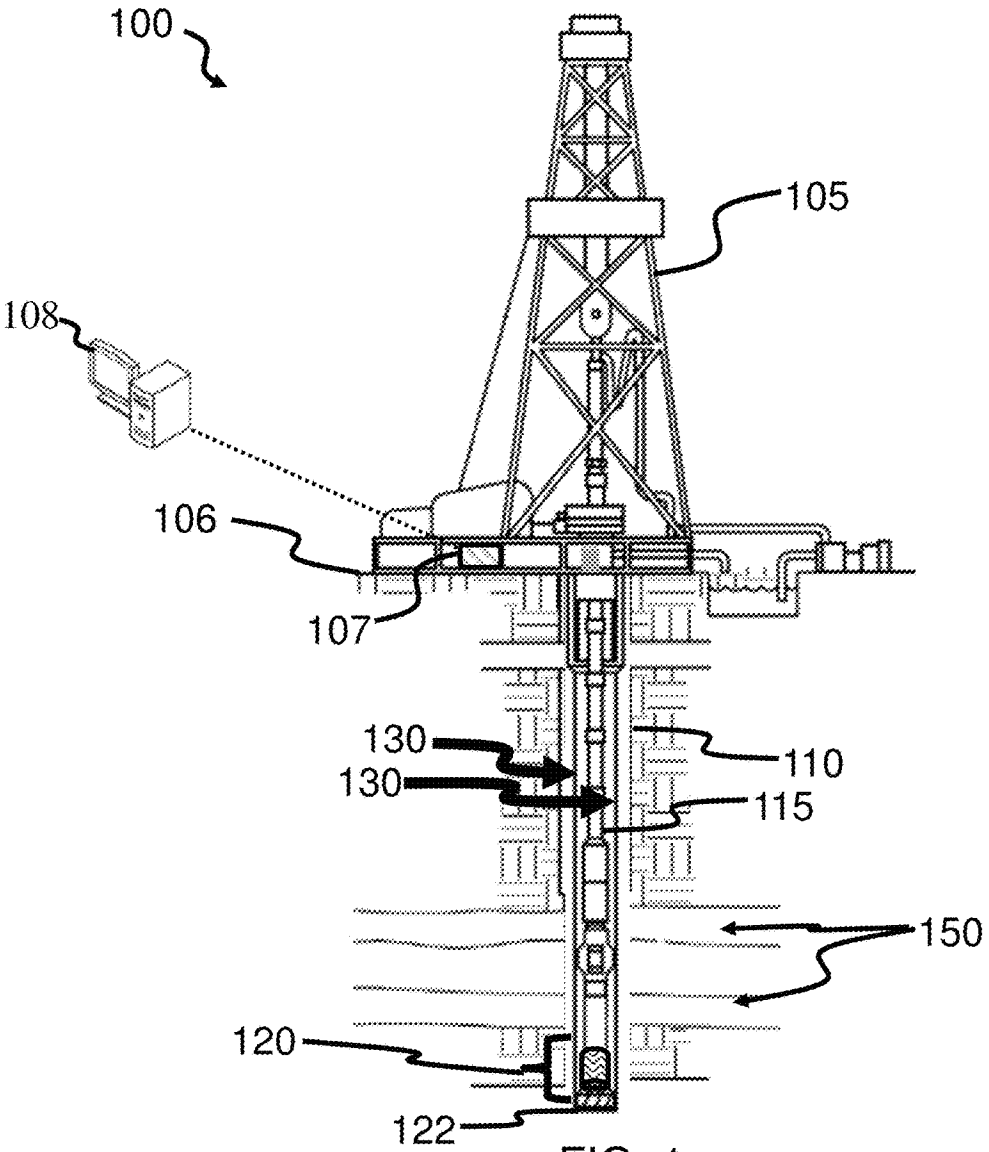
FIG. 1 is an illustration of a diagram of an example drilling system.

In borehole development, users, such as well operators or engineers, can use directional-drilling and geo-steering techniques to maintain borehole development, e.g., drilling operations, along an intended path and direction. Knowing the position and to project the future path of the borehole relative to nearby subterranean formations, proximate boreholes, and objects can be beneficial to ensure borehole distancing, separation, or borehole interception at the desired location, for example, maximizing the potential production from a subterranean formation reservoir. The borehole development can be for various uses, for example, hydrocarbon production, geothermal uses, scientific uses, mining uses, and other uses of boreholes.

The industry has been working towards improving drilling efficiencies, offset-well learning, and automated detection and interpretation of drilling events and dysfunctions. Challenges have arisen from the work to develop these drilling efficiencies.

(1) Different teams, product service lines (PSLs), entities, or different companies have developed differing solutions that target similar or complementary problems, and the differing solutions may not be compatible or combinable. These solutions can rely on different methodologies (e.g., data based, physics based, or hybrid) and can have different technology readiness levels.

(2) Some solutions can have conflicting objectives that need to be harmonized to provide a consistent set of actions and advisory drilling parameters for automating operations. Typical examples are rate of penetration (ROP) that is typically desired to be maximized from a drilling point of view while not exceeding a technical threshold from a hole cleaning point of view; or drilling parameter targets or limits from directional, mechanical, or hydraulic objectives can conflict as they seek to optimize different aspects of the drilling process.

For example, a vibration advisor can recommend mitigation actions to alleviate different vibration mechanisms. The vibration advisor can recommend increasing the RPM and reducing the weight-on-bit (WOB), if a stick-slip vibration occurs. From a hole cleaning and pressure management standpoint it may not be advisable to increase the RPM because increasing the RPM might exceed the equivalent circulating density (ECD) limit and not achieve the target ROP. Another example can occur with a bit bounce or whirl vibration situation. The vibration advisor can recommend decreasing the RPM to mitigate the vibration, whereas from a hole cleaning point of view the RPM must be increased to at least achieve the target ROP under current average conditions. During such conflicting scenarios it can be difficult for a user or a borehole system to determine the best recommendation from a drilling efficiency standpoint.

(3) There may not be a cohesive orchestration framework that encompasses the above challenges and the other factors that go into the well construction decision process. For non-conflicting solutions, a rule-based logic or decision tree-based framework can be implemented. For example, a rule can be implanted for removing critical rotations per minute (RPM) from a vibration point of view from the cleaning targets. The challenge with such rule-based approach can be that it is not scalable to orchestrate multiple solutions with conflicting recommendations in real-time or near real-time.

It would be beneficial to develop an efficient orchestration framework that can coordinate multiple recommendations from different systems and be able to scale up to accommodate as many factors, systems, or digital advisors as possible. The framework can be highly versatile and flexible to allow a user to integrate other systems or digital advisors. This type of orchestration framework can improve the decision making and operational efficiency of drilling operations of a borehole.

This disclosure presents processes to provide an orchestration framework that can generate one or more recommendations to direct well construction operations to maintain operations within a safe operating zone or to move the operation toward operating in the safe operating zone for the specified operations parameters by coordinating multiple recommendations from various systems in real-time or near real-time. Real-time or near real-time indicates that waiting for significant period of time is not needed. As new information is received, such as from downhole sensors, or new suggestions are received from digital advisors, the process can be performed again to determine a new set of recommendations.

In some aspects, it could take a time interval, such as more than one minute, for data to be transmitted from a downhole location to a surface computing system, therefore the time interval delay in receiving the data can be considered real-time or near real-time performance. In some aspects, near real-time can be specified as an interval of time before the process is performed, such as every five minutes, every twenty minutes, or another specified time interval.

Well construction operations can encompass various drilling activities, for example, drilling operations, active drilling within the borehole, tripping in or out, back reaming, casing placement, cementing, or other operations conducted within the borehole. The remaining descriptions utilize drilling operations to demonstrate and describe the disclosed processes, while the described processes can apply to the various well construction operations. The parameters used by the processes can be related to one or more of the drilling operation activities. For example, the parameters used can be controlled directly by the drilling operation, such as WOB, RPM, or flow rate, be an output of the drilling operation, such as ROP, ECD, or torque, or be related to off-bottom operations or phases.

In some aspects, the process can generate smart alerts in real-time or near real-time. In some aspects, the orchestration framework can provide a validation across systems, vendors, or other processes using a scalable orchestration logic. The process can utilize an orchestration framework utilizing impact maps.

An impact map can be a representation of a relationship of an impact severity level (on a relative or absolute scale, e.g., from 1 to 10, or other ranges) and drilling parameters, for example, RPM, WOB, flow rate, ROP, and other conventional drilling parameters. The impact map can be a one, two, three, or higher dimensional relationship. In some aspects, the impact map representation can be a mathematical representation, a graphical representation or a data relationship (such as stored in a database, data file, or other type of data relationship) stored on a computing system, file system, or other computing storage system. In some aspects, the impact map representation can be graphical or other visual representation of the data.

The impact severity levels can be determined prior to the start of a drilling operation (e.g., pre-job), such as by using literature surveys, information from subject matter experts, prior experiments in a lab, data and learnings from prior well construction operations at the current borehole or another borehole, industry data, or other data sources. They can be updated in real-time or near real-time depending on the set of circumstances. For example, a low level of stick-slip that lasts for a few seconds can have a low impact on the system, while a severe stick-slip event lasting more than 30 minutes can have a significant impact on the integrity of the system, e.g., the tool is outside limit, and need to be mitigated as soon as possible. In a similar manner, it can be important to know the relative level of risk involved if there is a hole cleaning issue, if the ECD limit is exceeded, or if a vibration occurs. The risk level can encapsulate the probability and the impact (in terms of time, cost, or both) of an identified limit or dysfunction.

During the well construction operation, depending on the recommended limits produced by the independent digital advisors, the impact maps can be generated in real-time or near real-time for each of the well construction parameters. The idea of limits can be extended to include "no-go" or "go" zones, relative or syntactic recommendations (e.g., increase or decrease), limits, and specific targets or setpoints. Once the individual impact maps are generated for each well construction parameter, an integrated impact map (i.e., a combined impact map) can be computed using the individual impact maps. Various algorithms can be used to perform the integration, for example, taking the maximum values to generate a maximum impact map. The integrated impact map can be further used to determine the safe operating zone for the well construction parameters. Within this zone, the impact level would typically be low or acceptable, and the critical impacts can be clearly identified.

In some aspects, the processes can include a scalable orchestration logic utilizing an impact assessment. In some aspects, the processes can include a computational method to combine the impact maps. In some aspects, the processes can include facilitating automated decision-making ability thereby increasing operational efficiency, such as providing the combined impact maps to a decision-making system where the combined impact maps can be used to determine a course of action. In some aspects, the processes can include an ability to recommend a safe operating zone to users or a drilling system in real-time or near real-time.

In some aspects, an ability to provide the user with the discretion to select one or more well construction parameters or impact parameters to be used in the analysis and recommendation generation. There can be situations where a sub-set of well construction operations can be used for a well construction operation. In some aspects, a smart alert management system can be used to communicate an alert to a user or a system (such as a well site controller or other borehole system) in real-time or near real-time using various types of alert systems. For example, an alert threshold can be exceeded when the current drilling parameters received from downhole and surface sensors indicate that the drilling assembly is not in a safe operating zone. In another example, an alert threshold can be exceeded when the one or more recommendations result in an impact severity greater than an alert threshold parameter. In some aspects, a user-friendly platform can be built for the orchestration framework.

This disclosure can provide benefits to the industry. In some aspects, this disclosure can improve the coordination among different systems or digital advisors, solution providers, or company systems thereby increasing the efficiency by orchestrating multiple recommendations produced by the various processes. In some aspects, the architecture of the orchestration framework can be versatile to enable an easier integration into another system or digital advisor, application, or process. This can improve the service value of the disclosed process. In some aspects, a user-friendly platform can be developed to implement the disclosure, such as using micro-services or other types of implementation platforms. In some aspects, the processes can act as an input into a drilling automation system. As a result, the process can save time of the drilling operation or of a user by reducing the amount of individual drilling parameters that are evaluated outside of the disclosed processes.

Turning now to the figures, FIG. 1 is an illustration of a diagram of an example drilling system 100, for example, a logging while drilling (LWD) system, a measuring while drilling (MWD) system, a seismic while drilling (SWD) system, a telemetry while drilling (TWD) system, injection well system, extraction well system, and other borehole systems. Drilling system 100 includes a derrick 105, a well site controller 107, and a computing system 108. Well site controller 107 includes a processor and a memory and is configured to direct operation of drilling system 100. Derrick 105 is located at a surface 106.

Extending below derrick 105 is a borehole 110 with downhole tools 120 at the end of a drill string 115. Downhole tools 120 can include various downhole tools, such as a formation tester or a BHA. Downhole tools 120 can include a resistivity tool or an ultra-deep resistivity tool. At the bottom of downhole tools 120 is a drilling bit 122. Other components of downhole tools 120 can be present, such as a local power supply (e.g., generators, batteries, or capacitors), telemetry systems, sensors, transceivers, and control systems. Borehole 110 is surrounded by subterranean formation 150.

Well site controller 107 or computing system 108 which can be communicatively coupled to well site controller 107, can be utilized to communicate with downhole tools 120, such as sending and receiving acoustic data, telemetry, data, instructions, subterranean formation measurements, and other information. Computing system 108 can be proximate well site controller 107 or be a distance away, such as in a cloud environment, a data center, a lab, or a corporate office. Computing system 108 can be a laptop, smartphone, PDA, server, desktop computer, cloud computing system, other computing systems, or a combination thereof, that are operable to perform the processes described herein. Well site operators, engineers, and other personnel can send and receive data, instructions, measurements, and other information by various conventional means, now known or later developed, with computing system 108 or well site controller 107. Well site controller 107 or computing system 108 can communicate with downhole tools 120 using conventional means, now known or later developed, to direct operations of downhole tools 120.

Casing 130 can act as barrier between subterranean formation 150 and the fluids and material internal to borehole 110, as well as drill string 115. An orchestration framework system can be present, such as an impact map analyzer (e.g., an impact map processor or an orchestration framework analyzer) or an orchestration framework controller (e.g., an impact map controller). The orchestration framework can receive input parameters from sensors located downhole, such as part of the downhole tools 120 or part of the bottom hole assembly (BHA). In some aspects, the orchestration framework can generate analysis of the impacts and determine recommendations for directing the drilling operations. In some aspects, the orchestration framework can produce visual graphs enabling a user to see where the safe operating zone is for the given drilling parameters and recommendations coming from different digital advisors in real-time. In some aspects, the orchestration framework can consider other data measurements to compute the safe operating zone, such as data measurements from another location within the borehole, proximate boreholes, a surface location, models, survey data, geological data, such as from a data center, database, or cloud environment.

In some aspects, the orchestration framework can communicate the recommendations (for example, the safe operating zone, the no-go zone, or other recommendations) to another system, such as computing system 108 or well site controller 107 where the recommendations can be combined with other analysis or used for decision making processes. In some aspects, computing system 108 can be the orchestration framework and can receive some of the input parameters from one or more of the sensors in downhole tools 120. In some aspects, well site controller 107 can be the orchestration framework and can receive some of the input parameters from one or more of the sensors part of downhole tools 120. In some aspects, the orchestration framework can be partially included with well site controller 107 and partially located with computing system 108.

FIG. 1 depicts onshore operations. Those skilled in the art will understand that this disclosure is equally well suited for use in offshore operations, geothermal operations, or hydraulic fracturing operations. FIG. 1 depicts specific borehole configurations, those skilled in the art will understand that the disclosure is equally well suited for use in boreholes having other orientations including vertical boreholes, horizontal boreholes, slanted boreholes, multilateral boreholes, and other borehole types.

Figure 2:
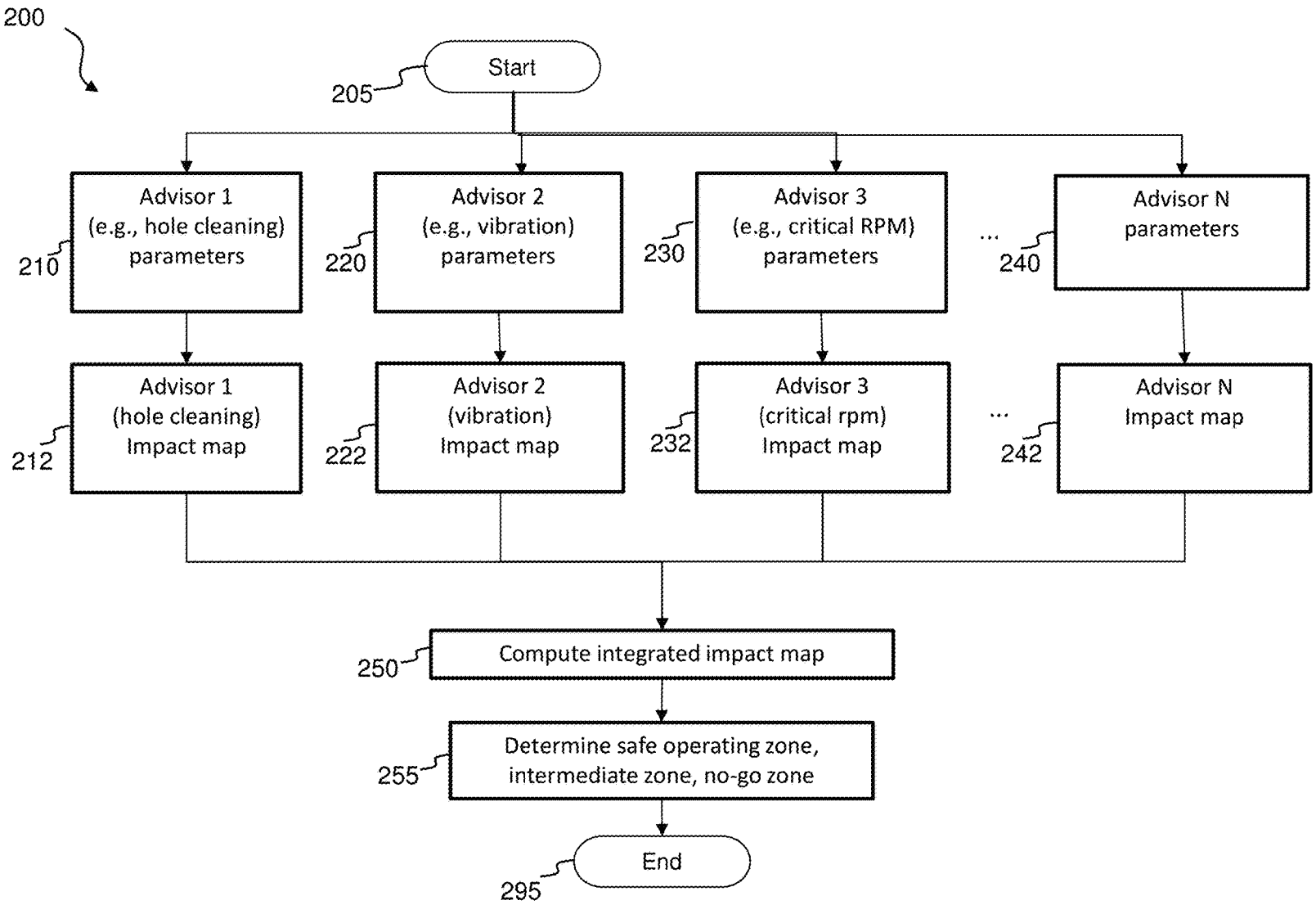
FIG. 2 is an illustration of a flow diagram of an example method for determining the various operating zones.

FIG. 2 is an illustration of a flow diagram of an example method 200 for determining the various operating zones. Method 200 can be performed on a computing system, for example, orchestration framework system 1000 of FIG. 10 or orchestration framework controller 1100 of FIG. 11. The computing system can be a reservoir controller, a well site controller, a geo-steering system, a data center, a cloud environment, a server, a laptop, a mobile device, smartphone, PDA, or other computing system capable of receiving the input parameters, and capable of communicating with other computing systems. Method 200 represents an algorithm that can be encapsulated in software code or in hardware, for example, an application, code library, dynamic link library, module, function, RAM, ROM, and other software and hardware implementations. The software can be stored in a file, database, or other computing system storage mechanism, such as an edge computing system. Method 200 can be partially implemented in software and partially in hardware.

Method 200 can perform the steps for the described processes, for example, collecting input parameters from sensors located downhole, surface sensors, data stores, other computing systems, or recommendations from the digital advisors, where data can be retrieved and analyzing the data to compute one or more recommendations. For example, input parameters can be received from downhole sensors, such as RPM, WOB, subterranean formation characteristics, borehole geometric properties, and other drilling parameters. Input parameters can be received from drilling rig sensors, such as WOB or rig limits. Input parameters can be received from other sources, such as engineering models, surveys, geological data, generally available stratigraphic data, and other data sources. Method 200 is a demonstration of some of the differing systems that can provide input parameters and a demonstration of some of the drilling parameters and impact parameters that are analyzed. In practice, the implementation can extend to various systems providing input parameters and to various drilling parameters now known or identified in the future, and various impact parameters.

Method 200 starts at a step 205 and proceeds to a step 210, a step 220, a step 230, or a step 240. Step 210, step 220, step 230, and step 240 can be performed in any order, serially, in parallel, overlapping, or various combinations thereof. In step 210, input parameters can be received that correspond to a particular application, process, system, or digital advisor, for example, an advisor that is concerned with hole cleaning and pressure management. The recommendations (that will be input to the orchestration framework) produced from such an advisor or application can be targets, limits, or set points for flow rate, RPM, or a limit for a maximum ROP to help ensure optimal hole cleaning and wellbore stability while drilling. The input parameters can include the impact parameter (which can include one or more impact values for the drilling parameter), the softness parameter, the drilling parameter, the targets (recommendations), or other data for generating the impact maps.

Proceeding from step 210 to a step 212, the input parameters are used to generate one or more impact maps. Well construction digital advisors, processes, applications, or systems provide independent recommendations in terms of RPM, WOB, flow rate, ROP, without explicit maps. In some aspects, some applications, such as vibrations, can utilize empirical relationships between parameters of the system, for example, the BHA design and the drilling parameters. In some aspects, the impact maps can be built from historical data, simulated data, or lab generated data. The primary output for each individual application is an impact map relating to the area of the recommended drilling parameters for that application. The one or more impact maps can be stored as data or can be used to generate a graph, such as a graph 300 of FIG. 3A or graph 400 of FIG. 4. Proceeding from step 212, method 200 proceeds to a step 250 where the impact maps generated in step 212 can be utilized to generate an integrated impact map for the given drilling parameters.

In step 220, method 200 follows a similar process as shown in step 210 where input parameters can be received that correspond to a particular application, process, system, or digital advisor, for example a system that is concerned with vibration. The recommendation produced by such a system can be syntactical, for example it may recommend whether to increase or decrease the current values of the drilling parameters depending on the type of vibration. The input parameters can include the impact parameter, softness parameter, the drilling parameter or recommendations, and other data for generating the impact maps. Proceeding from step 220 to a step 222, the input parameters are used to generate one or more impact maps. The impact maps can be stored as data or can be used to generate a graph, such as a graph 340 of FIG. 3B, graph 500 of FIG. 5A, or graph 540 of FIG. 5B. Proceeding from step 222, method 200 proceeds to step 250.

In step 230, method 200 follows a similar process as shown in step 210 and step 220 where input parameters can be received that correspond to a particular application, process, system, or digital advisor, for example, a system that is concerned with identifying a no-go zone or critical RPM. The input parameters can include the impact parameter, the softness parameter, the drilling parameter or critical RPMs, and other data for generating the impact maps. Proceeding from step 230 to a step 232, the input parameters are used to generate one or more impact maps. The impact maps can be stored as data or can be used to generate a graph, such as a graph 380 of FIG. 3C. Proceeding from step 232, method 200 proceeds to step 250.

In step 240, method 200 can follow a similar process where input parameters can be received from a different application, process, system, or digital advisor, up to N number where N can be any positive number. For example, there can be N number of digital advisors where each respective one can produce recommendations in real-time or near real-time during drilling or produce recommendations pre-job.

Proceeding from step 212, step 222, step 232 or step 242, method 200 proceeds to step 250. In step 250, after step 212, step 222, step 232, and step 242 have completed, the impact maps from each of the proceeding steps can be combined into an integrated impact map. Various algorithms can be utilized to generate the integrated impact map, such as a maximum algorithm, a minimum algorithm, a mean algorithm, a median algorithm, a weighted average algorithm, or other types of algorithms. For example, a maximum impact criterion can be used to integrate the impact maps.

In a step 255, the integrated impact map can be analyzed, along with the input parameters, to determine a safe operating zone, an intermediate operating zone, or a no-go zone, and one or more drilling recommendations for the drilling operations to achieve the safe operating zone.

In an optional step, the operating zone determinations can be represented visually, such as a contour area, to allow a user to analyze the one or more recommendations. In some aspects, the contour area can be represented in a two or three-dimensional representation, such as a surface plot. The surface plot can be utilized to evaluate the one or more recommendations to ensure the recommendations selected can achieve the goals of the drilling operation. Method 200 ends at a step 295.

Figure 3A:
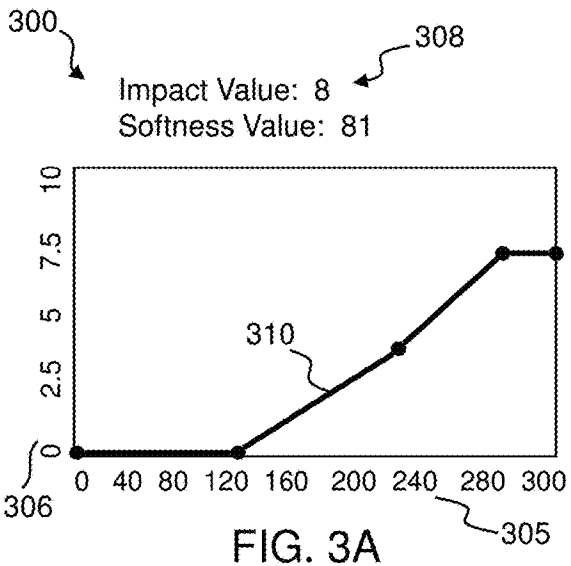
FIG. 3A is an illustration of a diagram of an example graph demonstrating a maximum rotations per minute (RPM) impact map for a first drilling system or a digital advisor.

FIG. 3A is an illustration of a diagram of an example graph 300 demonstrating a maximum RPM impact map for a first drilling system or a digital advisor. Graph 300 is a visual representation of a two dimensional graph for demonstration purposes. In some aspects, the analysis can be generated using data within a computing system without a visual component. In some aspects, the analysis can utilize three or more dimensions of data. Graph 300 has an x-axis 305 representing the drilling parameter values. Graph 300 has a y-axis 306 representing the impact severity. Graph 300 demonstrates input parameters from a maximum ROP or hole cleaning system, such as targets for flow rate, RPM, and a limit for maximum ROP to help ensure optimal hole cleaning and wellbore stability while drilling.

Some of the input parameters are the impact parameter and softness parameter for the specific drilling parameter being analyzed. A key 308 demonstrates these parameters with a sample impact value and a sample softness value. A plot line 310 illustrates the course of impact severity, using the values shown in key 308 if the current drilling RPM is below or above the maximum RPM recommended by the maximum ROP system or digital advisor.

Figure 3B:
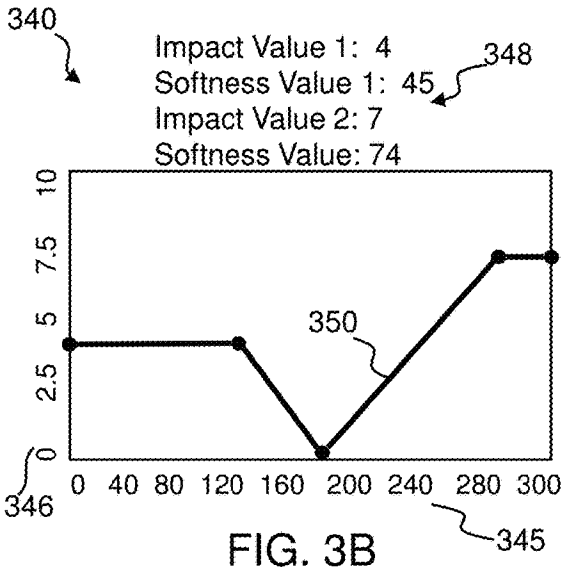
FIG. 3B is an illustration of a diagram of an example graph demonstrating a recommended RPM impact map.

FIG. 3B is an illustration of a diagram of an example graph 340 demonstrating a recommended RPM impact map. Graph 340 is a visual representation of a two dimensional graph for demonstration purposes. In some aspects, the analysis can be generated using data within a computing system without a visual component. In some aspects, the analysis can utilize three or more dimensions of data. Graph 340 has an x-axis 345 representing the drilling parameter values. Graph 340 has a y-axis 346 representing the impact severity. Graph 340 demonstrates input parameters from a second system.

Some of the input parameters are the impact parameter and softness parameter for the specific drilling parameter being analyzed. A key 348 demonstrates these parameters with two sample impact values and two sample softness values. A plot line 350 illustrates the course of impact severity, using the values shown in key 348 if the current drilling RPM is below or above the maximum RPM recommended by the second system.

Figure 3C:
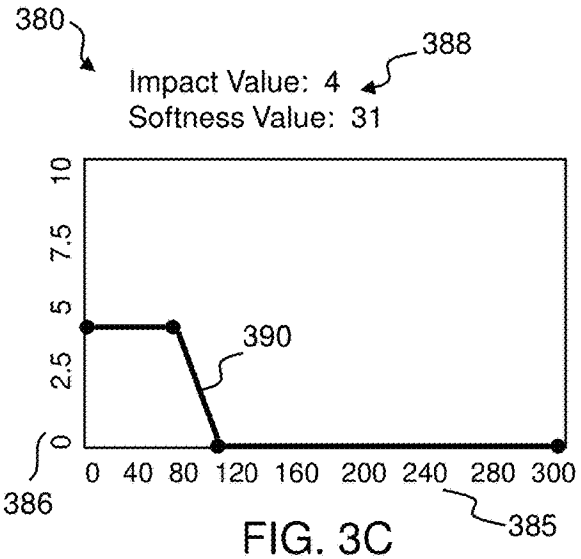
FIG. 3C is an illustration of a diagram of an example graph demonstrating a minimum RPM impact map.

FIG. 3C is an illustration of a diagram of an example graph 380 demonstrating a minimum RPM impact map. Graph 380 is a visual representation of a two-dimensional graph for demonstration purposes. In some aspects, the analysis can be generated using data within a computing system without a visual component. In some aspects, the analysis can utilize three or more dimensions of data. Graph 380 has an x-axis 385 representing the drilling parameter values. Graph 380 has a y-axis 386 representing the impact severity. Graph 380 demonstrates input parameters from a third system, such as a critical RPM system.

Some of the input parameters are the impact parameter and softness parameter for the specific drilling parameter being analyzed. A key 388 demonstrates these parameters with a sample impact value and a sample softness value. A plot line 390 illustrates the course of impact severity, using the values shown in key 388 if the current drilling RPM is below or above the maximum RPM recommended by the third system.

FIGS. 3A, 3B, and 3C demonstrate the use of the impact parameter and the softness parameter (e.g., the safety factor). The impact parameter can indicate the impact severity associated with a particular event, such as if the data plot exceeds the impact value along the y-axis, then the specified drilling parameters are not in the safe operating zone. The softness parameter can indicate how hard or soft the limit (impact value) can be, e.g., it can indicate how large the acceptable range of impact values can be, such as plus or minus the percentage represented by the softness value added to the impact value. The risk itself can be a combination of impact and probability. For example, the analysis can determine whether the impact of having a hole cleaning issue or the drilling operations exceeding a mechanical limitation increases abruptly or gradually, when the current drilling RPM is greater than the maximum RPM recommended by the maximum ROP system. Graph 300 demonstrates that the impact severity increases gradually as the current drilling RPM exceeds the maximum RPM (where the maximum RPM is 200 for this example). Graph 340 demonstrates a steep increase in the impact severity.

Each of these impact maps can be computed in real-time or near real-time. In some aspects, the impact maps can be updated at a time interval, at a user request, or when the input parameters for that impact map have been updated or changed. A single system can have more than one recommendation. For example, the maximum ROP system can recommend an RPM for achieving the target maximum ROP, and it can recommend a minimum and a maximum RPM from a hole cleaning and pressure management standpoint. These recommendations can be interpreted as three sub-components of the maximum ROP system, where each have an impact map. In another example, the second system can provide recommendations for RPM and WOB to mitigate observed vibrations. There can be four sub-components, for example one associated with stick-slip and the others related to bit bounce, whirl, and lateral shock.

Figure 4:
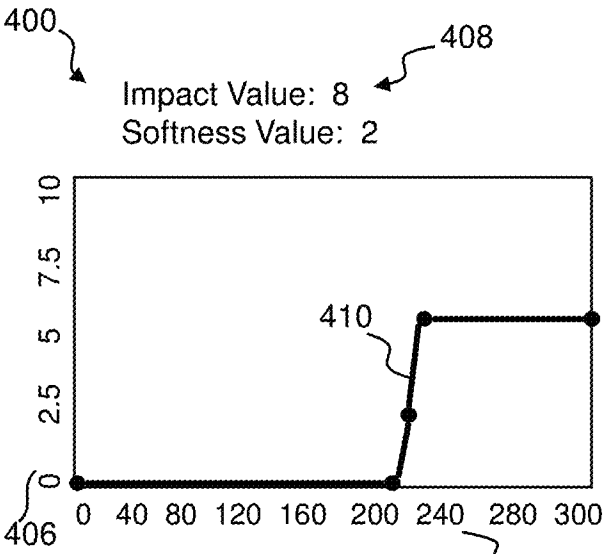
FIG. 4 is an illustration of a diagram of an example graph demonstrating a maximum RPM impact map for a second drilling system or a digital advisor.

FIG. 4 is an illustration of a diagram of an example graph 400 demonstrating a maximum RPM impact map for a second drilling system or a digital advisor. This system can be maximum RPM limit for MWD or rotary steerable system (RSS) tool. Graph 400 is a visual representation of a two-dimensional graph for demonstration purposes. In some aspects, the analysis can be generated using data within a computing system without a visual component. In some aspects, the analysis can utilize three or more dimensions of data. Graph 400 has an x-axis 405 representing the drilling parameter values. Graph 400 has a y-axis 406 representing the impact severity. Graph 400 demonstrates input parameters from the tool limit system, where a different set of input parameters are received.

Some of the input parameters are the impact parameter and softness parameter for the specific drilling parameter being analyzed. A key 408 demonstrates these parameters with a sample impact value and a sample softness value. A plot line 410 illustrates the course of impact severity, using the values shown in key 408 if the current drilling RPM is below or above the maximum RPM recommended by the tool limit system. An analysis of graph 400 can determine that the impact abruptly rises as the drilling RPMs pass 200, and so a recommendation not to exceed 200 RPMs can be determined.

Figure 5A:
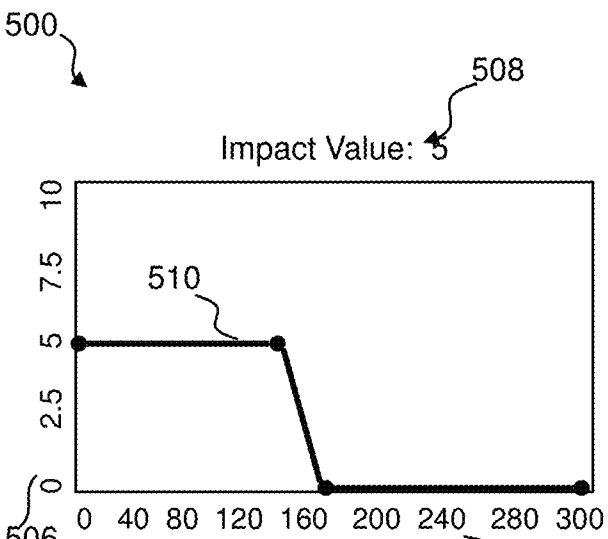
FIG. 5A is an illustration of a diagram of an example graph demonstrating a stickSlip RPM impact map.

FIG. 5A is an illustration of a diagram of an example graph demonstrating a stickSlip RPM impact map. Graph 500 is a visual representation of a two-dimensional graph for demonstration purposes. In some aspects, the analysis can be generated using data within a computing system without a visual component. In some aspects, the analysis can utilize three or more dimensions of data. Graph 500 has an x-axis 505 representing the drilling parameter values. Graph 500 has a y-axis 506 representing the impact severity. Graph 500 demonstrates input parameters from the second system.

Some of the input parameters are the impact parameters for the specific drilling parameter being analyzed. In this example, the softness parameter is not specified and therefore a default can be utilized. A key 508 demonstrates these parameters with a sample impact value. A plot line 510 illustrates the course of impact severity, using the values shown in key 508, if the current drilling RPM is below or above the maximum RPM recommended. An analysis of graph 500 can determine that the impact abruptly falls as the drilling RPMs pass 160, and so a recommendation of a minimum RPM can be determined.

Figure 5B:
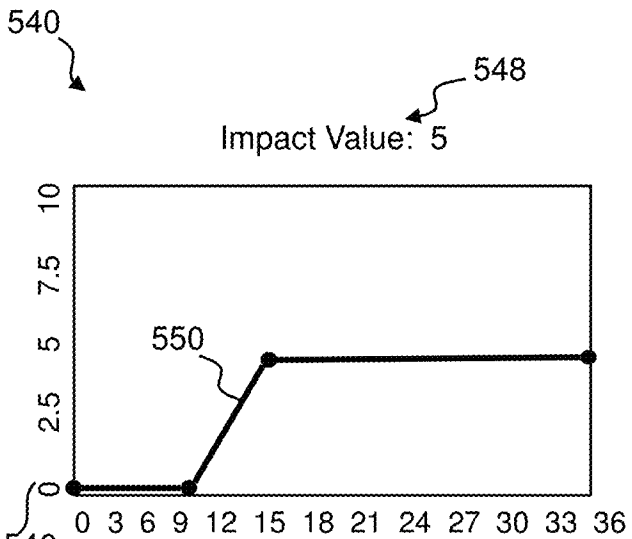
FIG. 5B is an illustration of a diagram of an example graph demonstrating a stickSlip weight on bit (WOB) impact map.

FIG. 5B is an illustration of a diagram of an example graph demonstrating a stickSlip WOB impact map. Graph 540 is a visual representation of a two-dimensional graph for demonstration purposes. In some aspects, the analysis can be generated using data within a computing system without a visual component. In some aspects, the analysis can utilize three or more dimensions of data. Graph 540 has an x-axis 545 representing the drilling parameter values. Graph 540 has a y-axis 546 representing the impact severity. Graph 540 demonstrates input parameters from the second system.

Some of the input parameters are the impact parameters for the specific drilling parameter being analyzed, such as specific impact values associated with specified drilling parameters. In this example, the softness parameter is not specified and therefore a default can be utilized. A key 548 demonstrates these parameters with a sample impact value. A plot line 550 illustrates the course of impact severity, using the values shown in key 548 if the current drilling RPM is below or above the maximum RPM recommended. An analysis of graph 540 can determine that the impact abruptly falls and then rises as the drilling RPMs pass from 120 to 240, and so a recommendation of a minimum and a maximum RPM can be determined.

FIGS. 5A and 5B demonstrate that input parameters from the same system can lead to overlapping recommendations when impact maps are computed. Determining the recommendation that can satisfy these disparate drilling parameters being analyzed is valuable for the drilling operations. FIGS. 3A, 3B, 3C, 4, 5A, and 5B demonstrate various impact parameters and softness parameters. These values can be specified as input parameters, such as from a user (e.g., a subject matter expert). These values can be adjusted prior to the impact map analysis being performed. Based on experience of the user or experience gained at the borehole site, these values can be adjusted accordingly.

Figure 6A:
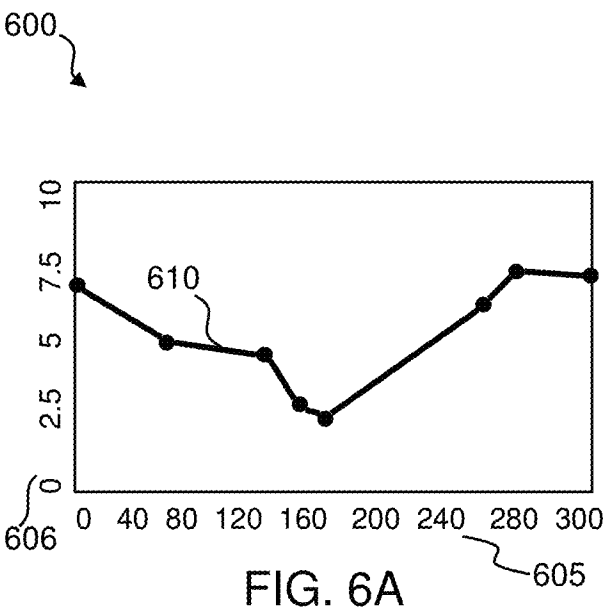
FIG. 6A is an illustration of a diagram of an example graph demonstrating an integrated impact map for RPM.

FIG. 6A is an illustration of a diagram of an example graph 600 demonstrating an integrated impact map for RPM integrating the impact maps shown in FIGS. 3A, 3B, 3C, 4 and 5A. Finding the maximum impact (at each drilling parameter value) was the algorithm used in FIG. 6A to integrate the impact maps. Graph 600 is a visual representation of a two-dimensional graph for demonstration purposes. In some aspects, the analysis can be generated using data within a computing system without a visual component. In some aspects, the analysis can utilize three or more dimensions of data. Graph 600 has an x-axis 605 representing the drilling parameter values. Graph 600 has a y-axis 606 representing the impact severity. Graph 600 demonstrates input from the impact maps related to RPM computed previously. A plot line 610 illustrates the course of maximum impact severity when combining the corresponding impact maps.

Figure 6B:
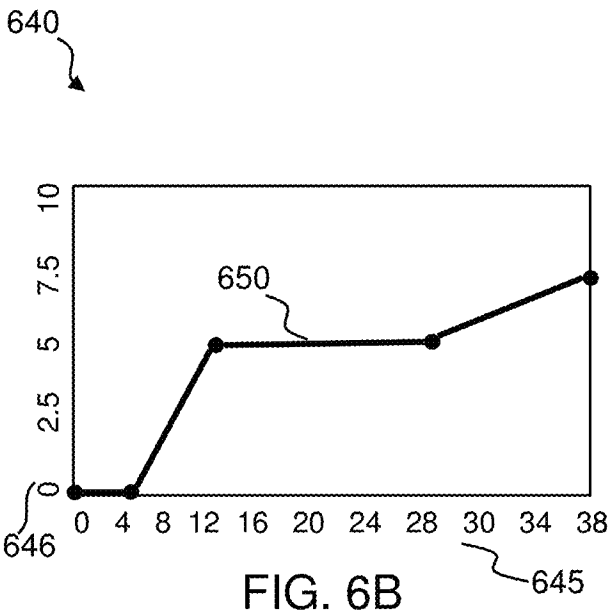
FIG. 6B is an illustration of a diagram of an example graph demonstrating an integrated impact map for WOB.

FIG. 6B is an illustration of a diagram of an example graph 640 demonstrating an integrated impact map for WOB. Graph 640 is a visual representation of a two-dimensional graph for demonstration purposes. In some aspects, the analysis can be generated using data within a computing system without a visual component. In some aspects, the analysis can utilize three or more dimensions of data. Graph 640 has an x-axis 645 representing the drilling parameter values. Graph 640 has a y-axis 646 representing the impact severity. Graph 640 demonstrates input from the impact maps related to RPM computed previously. A plot line 650 illustrates the course of maximum impact severity when combining the corresponding impact maps.

FIGS. 6A and 6B demonstrate the next step in the orchestration framework to combine the individual impact maps by a scalable logic. The disclosed processes perform this step by computing the maximum impact map using associated impact maps. In some aspects, impact maps can be first discretized, e.g., sampled, and then the impact severity values at the discrete points can be stored as vectors. This is demonstrated as the data points along plot line 610 and plot line 650. Next, the maximum value for each discrete point can be found among the identified vectors. The length of the vectors should be the same. Once the maximum impact severity values are found, the maximum impact map can be plotted as shown in FIG. 6A for RPM and FIG. 6B for WOB.

For example, the impact maps can be updated utilizing a prejob recommendation and a real-time or near real-time recommendation, wherein the updating utilizes an impact weighting for each impact severity, where the impact severity corresponds to a drilling parameter. The discretizing of each impact map in the one or more impact maps can be performed to determine a set of discrete points. A vector in a set of vectors can be stored, where each vector represents each impact severity value at each discrete point in the set of discrete points. A combinate value for each set of vectors for each discrete point in the set of discrete points can be calculated. Next, the integrated impact map can be computed utilizing the combinate value for each set of vectors. The integrated impact map can be utilized to determine the safe operating zone, the go zone, the no-go zone, or the intermediate zone. The drilling recommendations can be determined from the integrated impact map and the zone determinations.

Figure 7A:
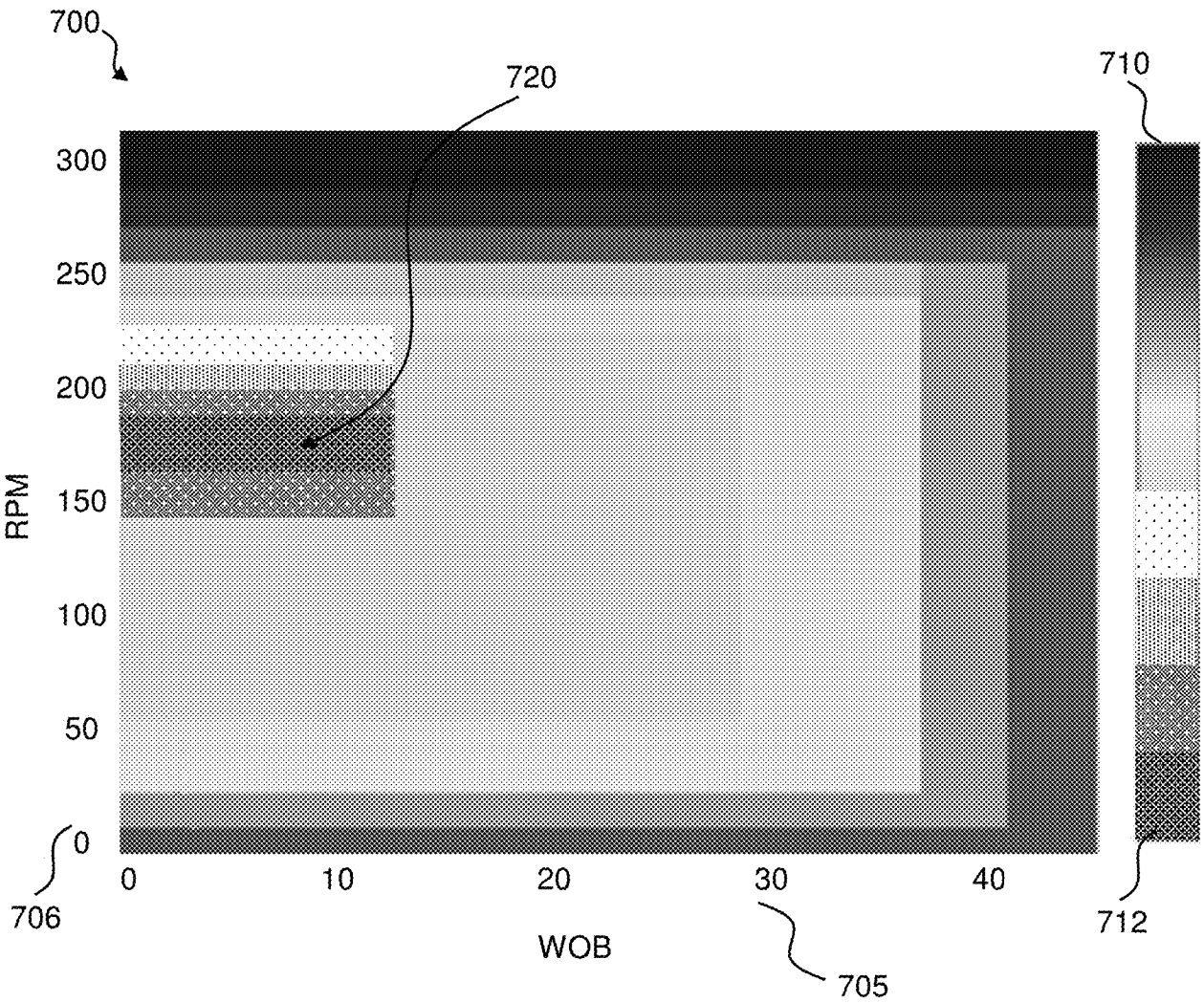
FIG. 7A is an illustration of a diagram of an example graph demonstrating an integrated impact map combining the impact maps of drilling parameters.

FIG. 7A is an illustration of a diagram of an example graph 700 demonstrating an integrated impact map combining the impact maps of drilling parameters. Graph 700 is a visual representation of a two-dimensional graph for demonstration purposes. In some aspects, the analysis can be generated using data within a computing system without a visual component. In some aspects, the analysis can utilize three or more dimensions of data. Graph 700 has an x-axis 705 showing the drilling parameters for WOB. Graph 700 has a y-axis 706 showing the surface RPMs. A key 710 shows a relative impact severity level where the dark bands on the top of key 710 are most severe, and the patterned bands of key 710 represent the lowest impact severity. Band 712 is the lowest impact severity level.

Band 712 is shown in graph 700 as a plot area 720. Plot area 720 represents the lowest impact severity level and therefore the highest recommendation to be communicated. For example, the recommendation could state having an RPM between 160 and 180, and a WOB between 0 and 14.

Figure 7B:
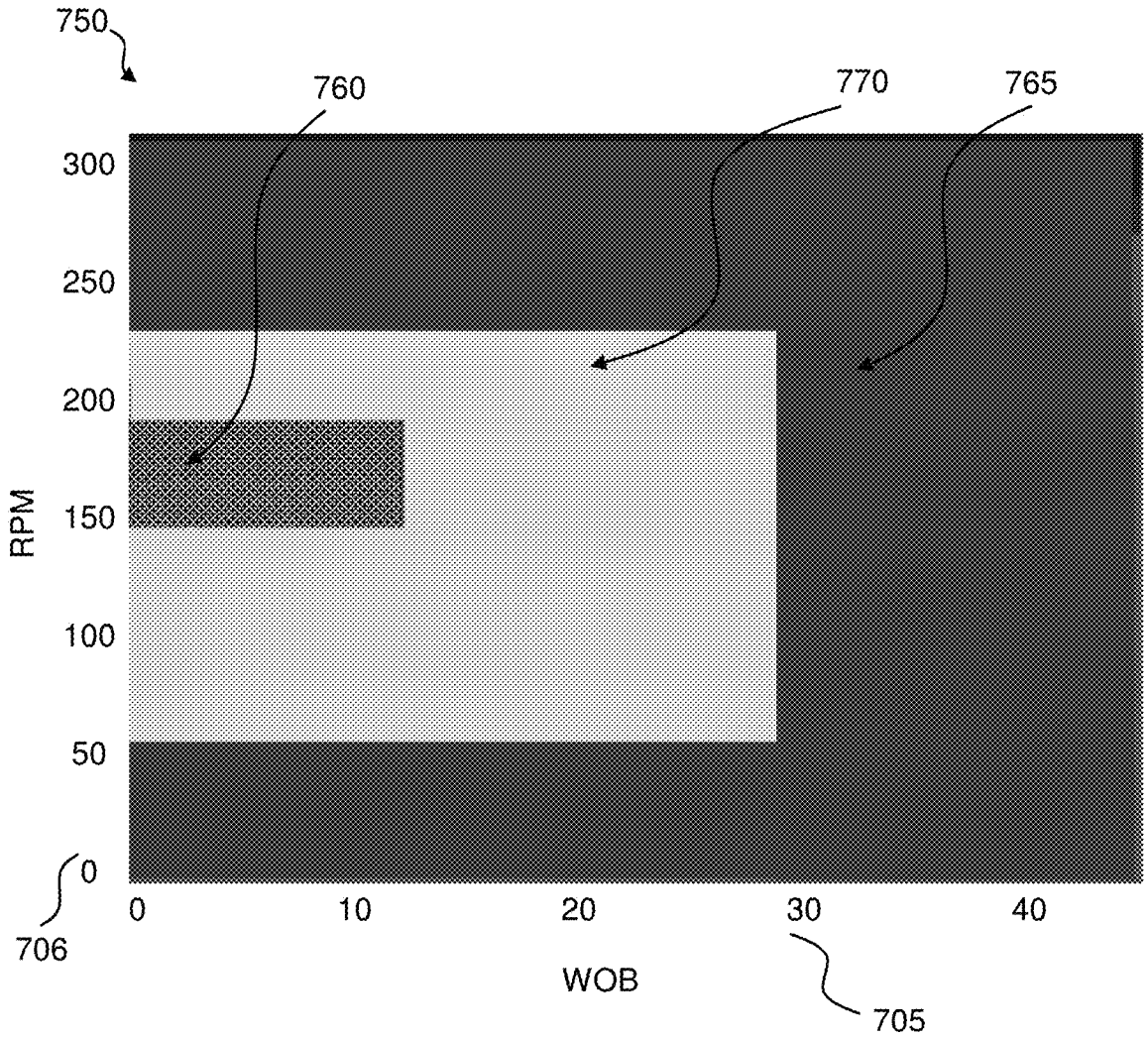
FIG. 7B is an illustration of a diagram of an example graph demonstrating a simplified integrated impact map.

FIG. 7B is an illustration of a diagram of an example graph 750 demonstrating a simplified integrated impact map. Graph 750 is a simplification of graph 700, where the granularity of the impact is captured by three zones: a safe zone, an intermediate zone, and a no-go zone. Plot area 760 represents the safe zone. Plot area 765 represents the highest impact severity level and therefore the no-go zone. Plot area 770 represents the region intervening the safe zone and the no-go zone, it is the intermediate zone. This zone is as significant recommendation as safe zone or no-go zone because having this information will assist the user to decide whether the limits or boundaries can be pushed further with the respect to the impact on the system.

Figure 8:
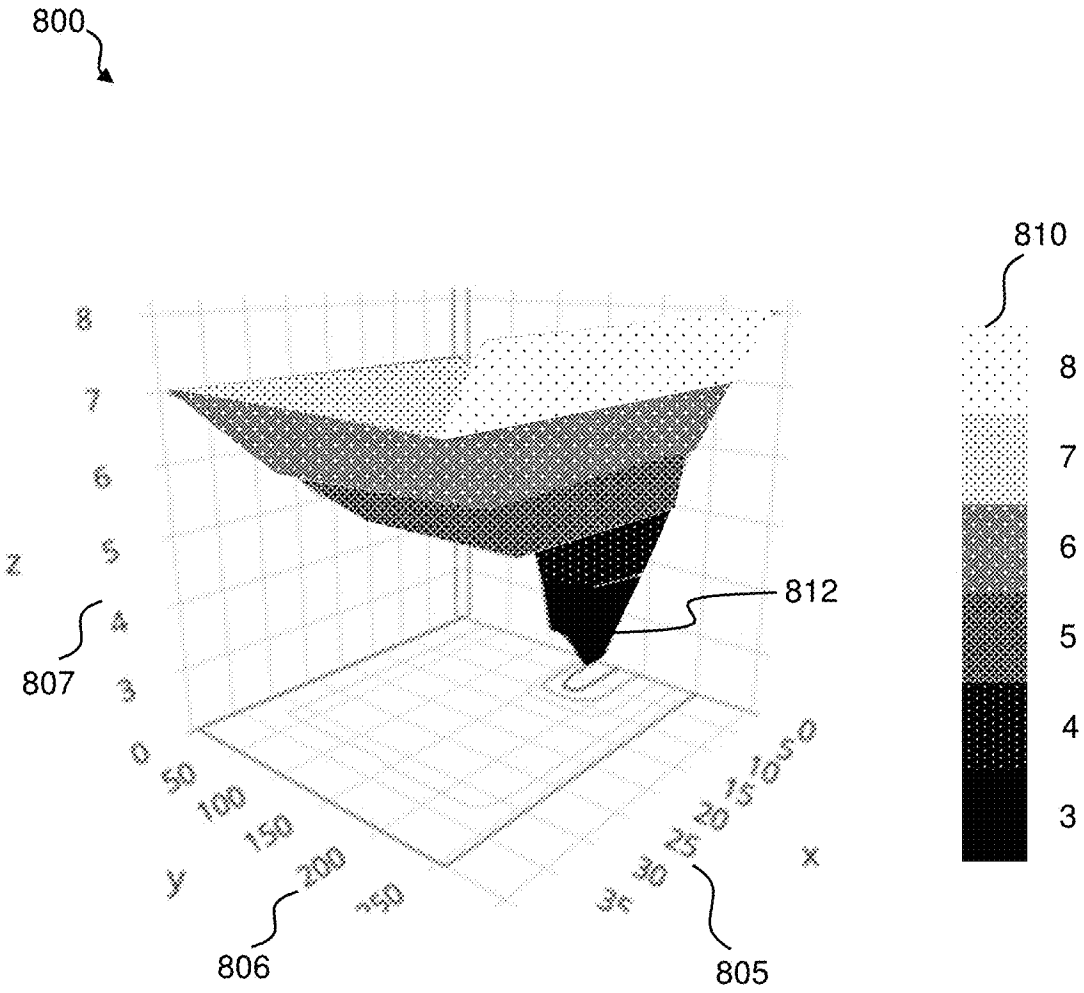
FIG. 8 is an illustration of a diagram of an example graph demonstrating a three-dimensional surface plot for the integrated impact map.

FIG. 8 is an illustration of a diagram of an example graph demonstrating a three-dimensional surface plot for the integrated impact map, for example, a type of combined impact map. Graph 800 is a visual representation of a two-dimensional graph for demonstration purposes. In some aspects, the analysis can be generated using data within a computing system without a visual component. In some aspects, the analysis can utilize three or more dimensions of data. Graph 800 has an x-axis 805 showing the drilling parameters for WOB. Graph 800 has a y-axis 806 showing the RPMs of the drill bit. Graph 800 has a z-axis 807 showing the relative impact severities. A key 810 shows a relative impact severity where the light bands on the top of key 810 are most severe, and the dark bands of key 810 represent the lowest impact severity. A section 812 is shown in graph 800 and represents the lowest impact severity and therefore the drilling parameters associated with section 812 can be the highest recommendation to be communicated.

FIGS. 7A, 7B, and 8 demonstrate the generation of a contour plot or a three-dimensional surface plot. The contour plot or the three-dimensional surface plot can then be used to extract the safe operating zone for the drilling parameters where the impact severity level is low or acceptable. In some aspects, they can also be used to extract the intermediate and no-go zones.

FIGS. 3A, 3B, 3C, 4, 5A, 5B, 6A, 6B, 7A, 7B, and 8 demonstrate the disclosed processes using a visual two-dimensional or three-dimensional graph, e.g., visually representing the algorithms. A visual component is not needed for the processes and is used herein to explain the processes. The processes can be performed within a computing system using the input parameters.

Figure 9:
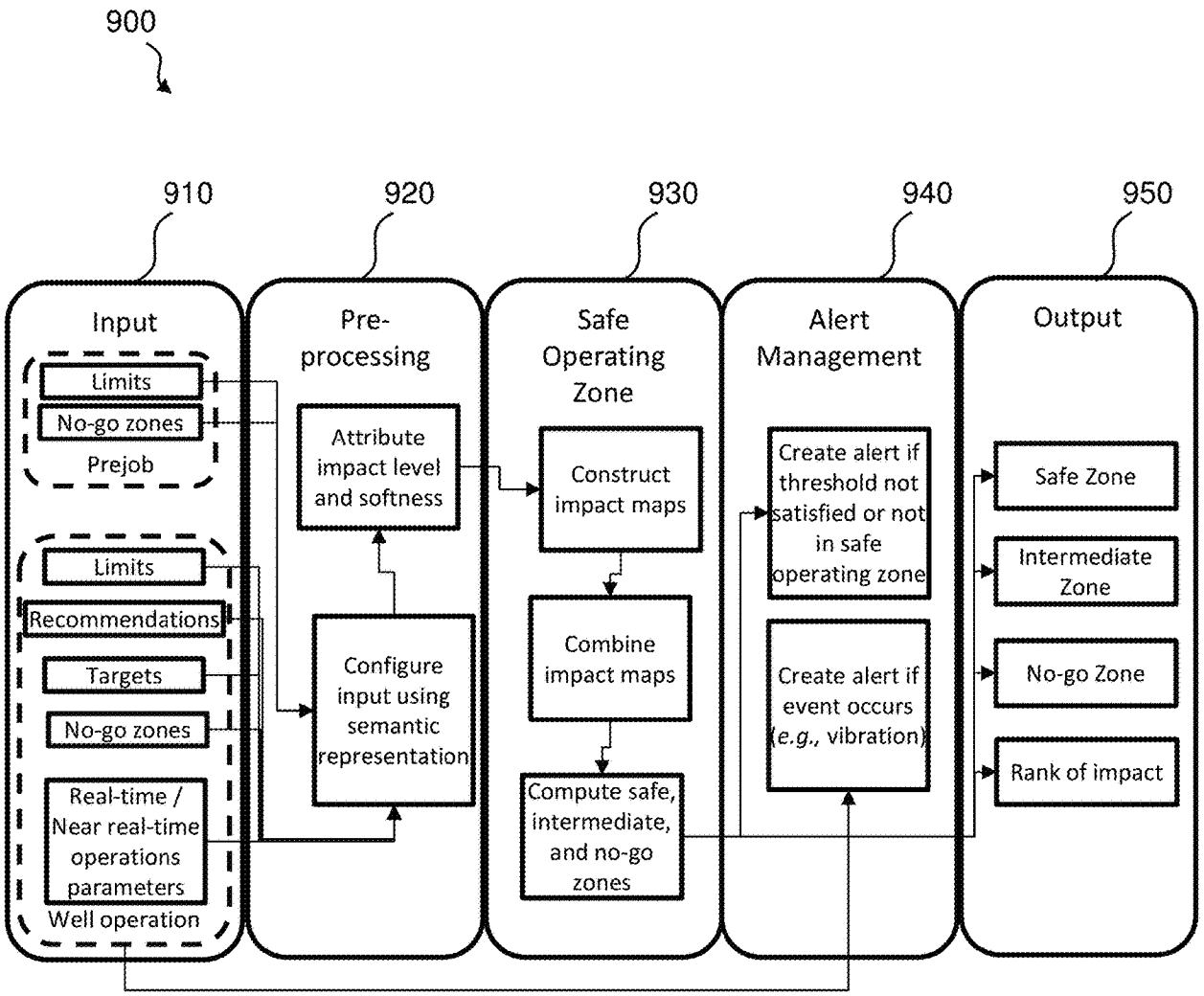
FIG. 9 is an illustration of a diagram of an example block flow demonstrating a process flow as described herein.

FIG. 9 is an illustration of a block diagram of an example flow 900 demonstrating a process flow as described herein. Flow 900 demonstrates a functional view of method 200 and the other described processes, e.g., an overview of the implementation of the orchestration framework. Flow 900 can be implemented, for example, by orchestration framework system 1000 or orchestration framework controller 1100.

In a flow block 910, various input parameters can be received. In some aspects, well construction parameters can be received, for example, limits, targets, set-points, recommendations (increase/decrease the parameter), go zones, no-go zones, real-time or near real-time data from sensors located downhole, survey parameters, geological parameters, surface sensors, and other parameter sources. The various parameters can be received from one or more systems, PSLs, applications, digital advisors, or companies. The input parameters can be received as a prejob parameter and updated as the real-time or near real-time parameters are received.

In a flow block 920, preprocessing can be performed. Preprocessing can analyze the input parameters to ensure consistent scaling and representation. The input recommendations to the orchestration framework can be in various forms. They can be go zones, no-go zones, limits, syntactic recommendations (increase/decrease), or targets. The algorithm for computing the safe operating zone can interpret these input recommendations in a correct way. In some aspects, a preprocessing step can put these recommendations in an object-oriented semantic representation to improve the efficiency of the applied algorithms. Preprocessing can attribute the impact parameter, e.g., risk parameter, and the softness parameter. The impact parameter and softness parameter can be defaulted or can be specified as part of the input parameters.

In a flow block 930, the safe operating zone, intermediate, or no-go zones can be determined. To determine these zones, each of the input parameters can be analyzed using an impact map, for example, an individual impact map for each well construction parameter. One or more of the impact maps can be combined to compute an integrated impact map. The integrated impact map can be utilized to determine the safe operating zone, no-go zone, or intermediate zone. Recommendations can be determined that can be communicated to a user, a user system, a well site controller, a drilling system, or other well construction system, where the recommendations can be used to direct operations to keep the well construction operations in the safe operating zone or to direct operations towards the safe operating zone or to direct operations away from the no-go zone. The integrated impact maps can be represented by a contour map or a surface plot map.

In a flow block 940, a check can be made whether the output from flow block 930 exceeds one or more alert thresholds. For example, the analysis can determine that the well construction parameters are currently outside of the safe operating zone or within the no-go zone, or that there are no recommendations that are within the impact severity limits. An alert management system can receive the alert threshold information from flow block 930 and communicate the alert to a user, a user system, a well site controller, a drilling system, or other systems for further action. Alert thresholds can be specified for different systems, PSLs, digital advisors, applications, or company sources of input parameters. For example, if there is a vibration whose severity is critical, or if there is a hole cleaning issue, an alert can be sent out. For one or more systems utilizing an analysis of their individual impact maps an alert can be triggered and sent to the user.

In a block flow 950, the recommendations in the form of safe zone, intermediate or no-go zones, the combined impact maps, or other outputs can be communicated to one or more other systems. For example, the combined impact maps can be displayed for a user along with a ranking of the recommendations utilizing the overall impact severity, e.g., The ranking of different digital advisors, systems, or applications accounting for the highest to lowest impact on the well construction system.

Figure 10:
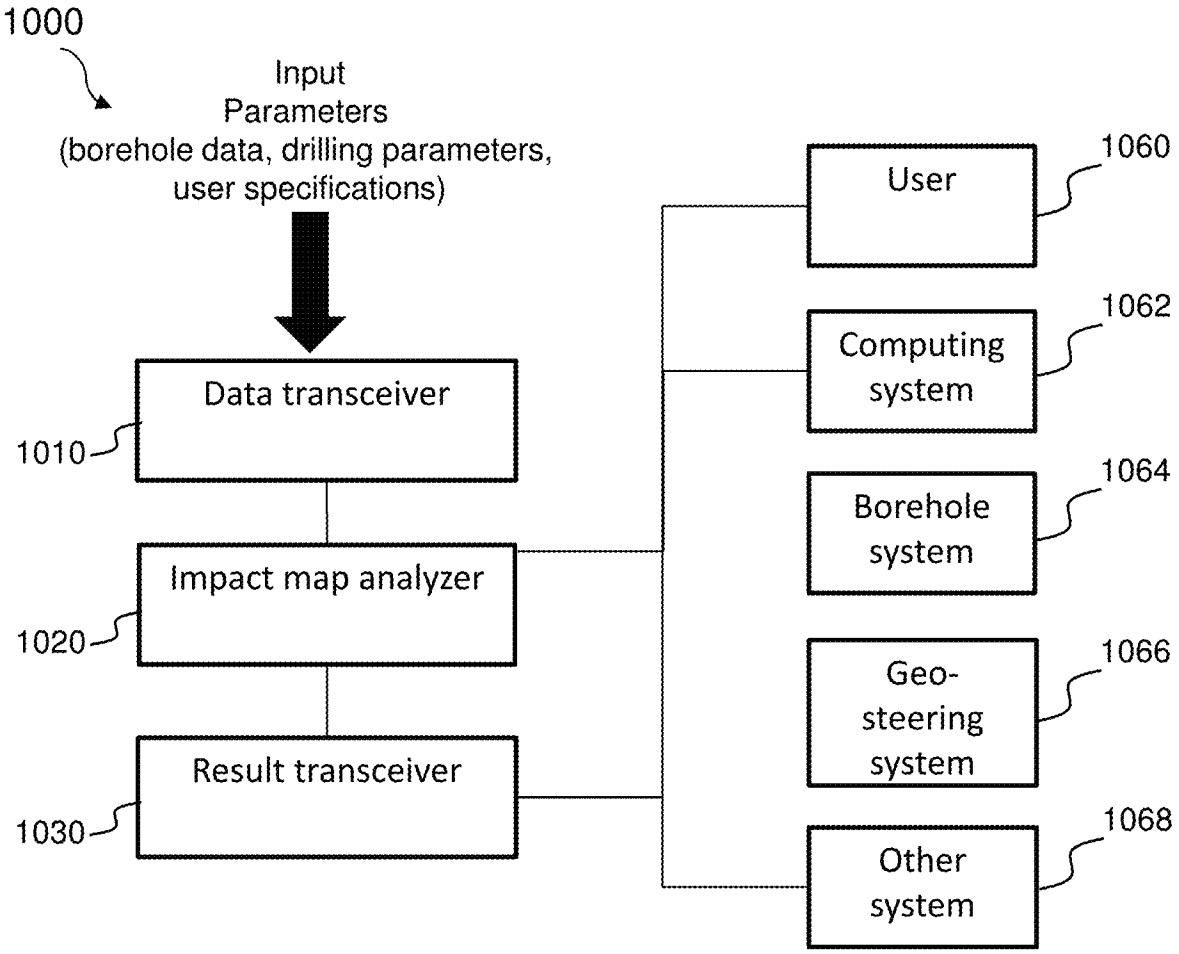
FIG. 10 is an illustration of a block diagram of an example orchestration framework system.

FIG. 10 is an illustration of a block diagram of an example orchestration framework system 1000, which can be implemented in one or more computing systems, for example, a data center, cloud environment, server, laptop, smartphone, tablet, and other computing systems. In some aspects, orchestration framework system 1000 can be implemented using a orchestration framework controller such as orchestration framework controller 1100 of FIG. 11. Orchestration framework system 1000 can implement one or more methods of this disclosure, such as method 200 of FIG. 2.

Orchestration framework system 1000, or a portion thereof, can be implemented as an application, a code library, a dynamic link library, a function, a module, other software implementation, or combinations thereof. In some aspects, orchestration framework system 1000 can be implemented in hardware, such as a ROM, a graphics processing unit, or other hardware implementation. In some aspects, orchestration framework system 1000 can be implemented partially as a software application and partially as a hardware implementation. Orchestration framework system 1000 shows components that perform functions of the disclosed processes, and an implementation can combine or separate at least some of the described functions in one or more software or hardware systems.

Orchestration framework system 1000 includes a data transceiver 1010, an impact map analyzer 1020, and a result transceiver 1030. Data transceiver 1010, impact map analyzer 1020, and result transceiver 1030 can be, or can include, conventional interfaces configured for transmitting and receiving data. Data transceiver 1010 can receive input parameters, such as parameters to direct the operation of the analysis implemented by impact map analyzer 1020, such as identifying which algorithms to utilize and specifying operational parameters. In some aspects, data transceiver 1010 can be part of impact map analyzer 1020.

Impact map analyzer 1020 can be an impact map processor and can implement the analysis and algorithms as described herein utilizing the input parameters. For example, impact map analyzer 1020 can perform the analysis of the input parameters, compute impact maps and integrated impact maps, generate one or more recommendations, and communicate the results to other systems, such as a reservoir planning system, a drilling planning system, a geo-steering system, a well site controller, or other well site systems. In some aspects, impact map analyzer 1020 can be a machine learning system, such as providing a process to analyze the collected input parameters from downhole sensors to provide a quality check on the data and to fill in potential gaps in the data.

A memory or data storage of impact map analyzer 1020 can be configured to store the processes and algorithms for directing the operation of impact map analyzer 1020. Impact map analyzer 1020 can also include one or more processors that is configured to operate according to the analysis operations and algorithms disclosed herein, and an interface to communicate (transmit and receive) data.

Result transceiver 1030 can communicate one or more results, analysis, or interim outputs, to one or more data receivers, such as a user or user system 1060, a computing system 1062, a borehole system 1064, a geo-steering system 1066, or other systems 1068 for processing or storing the recommendations, e.g., using a data store or database, whether located proximate result transceiver 1030 or distant from result transceiver 1030. The results, e.g., a determination of the recommendations, contour graphs, surface plots, interim outputs from impact map analyzer 1020, and other outputs, can be communicated to one or more of the data receivers for processing or storing data. The results can be used, for example, as inputs into a reservoir operation plan, a drilling plan, to determine the directions provided to a geo-steering system or used as inputs into a well site controller or other borehole system, such as a well site operation planning system.

Figure 11:
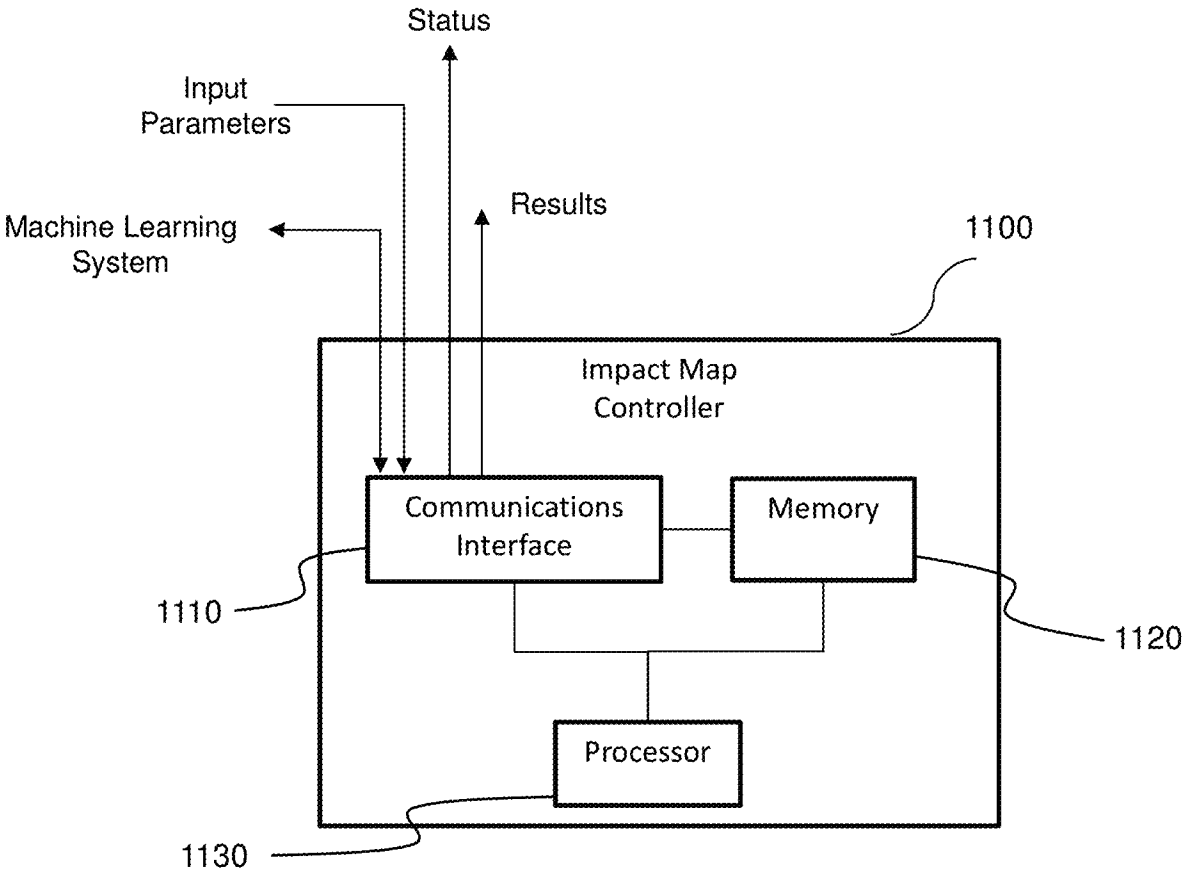
FIG. 11 is an illustration of a block diagram of an example of orchestration framework controller according to the principles of the disclosure.

FIG. 11 is an illustration of a block diagram of an example of orchestration framework controller 1100 according to the principles of the disclosure. Orchestration framework controller 1100 can be stored on a single computer or on multiple computers. The various components of orchestration framework controller 1100 can communicate via wireless or wired conventional connections. A portion or a whole of orchestration framework controller 1100 can be located at one or more locations, such as a data center, a reservoir controller, an edge computing system, a cloud environment, a server, a laptop, a smartphone, or other locations. In some aspects, orchestration framework controller 1100 can be wholly located at a downhole, a surface, or distant location. In some aspects, orchestration framework controller 1100 can be part of another system, and can be integrated in a single device, such as a part of a reservoir operation planning system, a well site controller, a geo-steering system, or other borehole system.

Orchestration framework controller 1100 can be configured to perform the various processes disclosed herein including receiving input parameters, and generating recommendations from an execution of the methods and processes described herein. Orchestration framework controller 1100 includes a communications interface 1110, a memory 1120, and one or more processors represented by processor 1130.

Communications interface 1110 is configured to transmit and receive data. For example, communications interface 1110 can receive the input parameters, downhole sensor parameters, and other data. Communications interface 1110 can transmit the determined recommendations, data from the input parameters, contour graphs, surface plots, or interim outputs. In some aspects, communications interface 1110 can transmit a status, such as a success or failure indicator of orchestration framework controller 1100 regarding receiving the various inputs, transmitting the determined recommendations, or producing the determined recommendations.

In some aspects, communications interface 1110 can receive input parameters from a machine learning system, for example, where the downhole sensor parameters are processed using one or more filters and algorithms prior to computing the impact maps.

In some aspects, the machine learning system can be implemented by processor 1130 and perform the operations as described by impact map analyzer 1020. Communications interface 1110 can communicate via communication systems used in the industry. For example, wireless or wired protocols can be used. Communication interface 1110 is capable of performing the operations as described for data transceiver 1010 and result transceiver 1030 of FIG. 10.

Memory 1120 can be configured to store a series of operating instructions that direct the operation of processor 1130 when initiated, including the code representing the algorithms used for processing the collected data. Memory 1120 is a non-transitory computer readable medium. Multiple types of memory can be used for data storage and memory 1120 can be distributed.

Processor 1130, e.g., an impact map processor or a maximum impact processor, can be configured to produce the generated results, e.g., the one or more recommendations, impact map contours, surface plots, one or more interim outputs, and statuses utilizing the received inputs. Processor 1130 can be configured to direct the operation of orchestration framework controller 1100. Processor 1130 includes the logic to communicate with communications interface 1110 and memory 1120, and perform the functions described herein, such as functions according to method 200. Processor 1130 can perform or direct the operations as described by impact map analyzer 1020 of FIG. 10.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions, and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the disclosed aspects in the SUMMARY can have one or more of the following additional elements in combination. Element 1: communicating, using a result transceiver, the one or more drilling recommendations to a borehole system, wherein the borehole system is one or more of a reservoir system, a drilling system, a geo-steering system, a well site system, or a user system. Element 2: alerting a user or the borehole system when the one or more drilling recommendations determines an alert threshold is exceeded. Element 3: triggering an alert when the one or more drilling recommendations is not in the safe operating zone, or the one or more drilling recommendations is within the no-go zone. Element 4: wherein the one or more drilling recommendations are used to direct future drilling operations. Element 5: wherein each impact map in the set of impact maps relate to one drilling parameter. Element 6: wherein at least one impact map in the set of impact maps is generated in real-time or near real-time of receipt of the input recommendations. Element 7: wherein the input recommendations specify the no-go zone, a go zone, a specific target, a limit, or a relative direction for future drilling operations. Element 8: wherein a portion of the input parameters are selected prejob by a user prior to the generating the set of impact maps. Element 9: wherein a portion of the input parameters are determined by one or more of a user, a default parameter, or a machine learning system. Element 10: wherein the computing the integrated impact map further includes updating the set of impact maps utilizing a prejob recommendation and a real-time or near real-time recommendation, wherein the updating utilizes an impact weighting for each impact severity, wherein the impact severity level corresponds to one drilling parameter in the set of drilling parameters; Element 11: wherein the computing the integrated impact map further includes discretizing each impact map in the set of impact maps to determine a set of discrete points; Element 12: wherein the computing the integrated impact map further includes storing as a vector in a set of vectors, each impact severity value at each discrete point in the set of discrete points; Element 13: wherein the computing the integrated impact map further includes calculating a combinate value for each of the set of vectors at each discrete point in the set of discrete points for the set of impact maps; and Element 14: wherein the computing the integrated impact map further includes computing the integrated impact map utilizing the combinate value for each of the set of vectors, wherein the integrated impact map is utilized to determine the safe operating zone, the no-go zone, and the intermediate zone. Element 15: a machine learning system, capable of communicating with the data transceiver and the impact processor, performing an analysis of the input parameters to generate the one or more impact maps. Element 16: a result transceiver, capable of communicating the one or more drilling recommendations and interim outputs to a user system, a data store, or a computing system. Element 17: wherein the computing system is a geo-steering system, and the geo-steering system utilizes the one or more drilling recommendations to adjust drilling operations. Element 18: wherein the impact processor is further capable of generating a visual representation of the integrated impact map. Element 19: Wherein a user identifies a user specified recommendation, a user identified safe operating zone, or a user identified no-go zone using the visual representation. Element 20: an alert management system, capable of receiving the one or more drilling recommendations and generating an alert, using the one or more drilling recommendations, when an alert threshold is exceeded.

What is claimed is:

1. A method, comprising:

receiving input parameters for a location within a borehole, wherein the input parameters include input recommendations for a set of drilling parameters from more than one digital advisor, a respective impact parameter and a softness parameter for each drilling parameter in the set of drilling parameters, subterranean formation parameters near the location, and characteristics and parameters of a drilling assembly utilized within the borehole;

generating a set of impact maps utilizing the input parameters, wherein each impact map in the set of impact maps is a correlation of an impact severity level with a drilling parameter in the set of drilling parameters, the softness parameter includes softness values and indicates an acceptable range of impact values as specified by the impact parameter, and the correlation for the drilling parameter utilizes at least one impact value from the impact parameter and at least one of the softness values from the softness parameter;

computing an integrated impact map utilizing the set of impact maps and a determined integration algorithm; and determining one or more drilling recommendations utilizing the set of impact maps, and the input parameters, wherein the one or more drilling recommendations specify at least one of a safe operating zone, an intermediate zone, or a no-go zone; and modifying directions provided to a geo-steering system of a drill bit using the one or more drilling recommendations.

2. The method as recited in claim 1, further comprising:

communicating, using a result transceiver, the one or more drilling recommendations to a borehole system, wherein the borehole system is one or more of a reservoir system, a drilling system, a geo-steering system, a well site system, or a user system.

3. The method as recited in claim 2, further comprising:

alerting a user or the borehole system when the one or more drilling recommendations determines an alert threshold is exceeded.

4. The method as recited in claim 1, furthering comprising:

triggering an alert when the one or more drilling recommendations is not in the safe operating zone, or the one or more drilling recommendations is within the no-go zone.

5. The method as recited in claim 1, wherein the one or more drilling recommendations are used to direct future drilling operations.

6. The method as recited in claim 1, wherein each impact map in the set of impact maps relate to one drilling parameter.

7. The method as recited in claim 1, wherein at least one impact map in the set of impact maps is generated in real-time or near real-time of receipt of the input recommendations.

8. The method as recited in claim 1, wherein the input recommendations specify the no-go zone, a go zone, a specific target, a limit, or a relative direction for future drilling operations.

9. The method as recited in claim 1, wherein a portion of the input parameters are selected prejob by a user prior to the generating the set of impact maps.

10. The method as recited in claim 1, wherein a portion of the input parameters are determined by one or more of a user, a default parameter, or a machine learning system.

11. The method as recited in claim 1, wherein the computing the integrated impact map further comprises:

updating the set of impact maps utilizing a prejob recommendation and a real-time or near real-time recommendation, wherein the updating utilizes an impact weighting for each impact severity, wherein the impact severity level corresponds to one drilling parameter in the set of drilling parameters;

discretizing each impact map in the set of impact maps to determine a set of discrete points;

storing as a vector in a set of vectors, each impact severity value at each discrete point in the set of discrete points;

calculating a combinate value for each of the set of vectors at each discrete point in the set of discrete points for the set of impact maps; and computing the integrated impact map utilizing the combinate value for each of the set of vectors, wherein the integrated impact map is utilized to determine the safe operating zone, the no-go zone, and the intermediate zone.

12. A system, comprising:

a communications interface, capable of receiving input parameters for a location within a borehole, wherein the input parameters include one or more of recommendations used to determine drilling parameters from various digital advisors in real-time or near real-time, subterranean formation parameters near the location, drilling parameters, characteristics and parameters of a drilling assembly utilized within the borehole, or input impact values and softness values corresponding to the drilling parameters; and an impact processor, capable of communicating with the communications interface, generating one or more impact maps utilizing the input parameters, computing an integrated impact map utilizing the one or more impact maps, and determining one or more drilling recommendations utilizing the integrated impact map, the one or more impact maps, and the input parameters, wherein, the one or more impact maps is a correlation of an impact severity level and the drilling parameters, and the correlation utilizes at least one impact value from a range of impact values and one softness value for each drilling parameter, the softness value specifies the range of impact values using the input impact values, the one or more drilling recommendations specify a safe operating zone, a no-go zone, or an intermediate zone for the drilling parameters, modifying directions provided to a geo-steering system of a drill bit using the one or more drilling recommendations.

13. The system as recited in claim 12, further comprising:

a machine learning system, capable of communicating with the data communications interface and the impact processor, performing an analysis of the input parameters to generate the one or more impact maps.

14. The system as recited in claim 12, further comprising:

a result transceiver, capable of communicating the one or more drilling recommendations and interim outputs to a user system, a data store, or a computing system.

15. The system as recited in claim 14, wherein the computing system is a geo-steering system, and the geo-steering system utilizes the one or more drilling recommendations to adjust drilling operations.

16. The system as recited in claim 12, wherein the impact processor is further capable of generating a visual representation of the integrated impact map, and a user identifies a user specified recommendation, a user identified safe operating zone, or a user identified no-go zone using the visual representation.

17. The system as recited in claim 12, further comprising:

an alert management system, capable of receiving the one or more drilling recommendations and generating an alert, using the one or more drilling recommendations, when an alert threshold is exceeded.

18. A computer program product having a series of operating instructions stored on a non-transitory computer-readable medium that directs a data processing apparatus when executed thereby to perform operations to determine one or more drilling recommendations, the operations comprising:

receiving input parameters for a location within a borehole, wherein the input parameters at least include input recommendations for a set of drilling parameters from more than one digital advisor;

generating a set of impact maps utilizing the input parameters, wherein each impact map in the set of impact maps is a correlation of an impact severity level with a drilling parameter in the set of drilling parameters, and the correlation utilizes at least one impact value from a range of impact values and one softness value for the drilling parameter, where the softness value specifies the range of impact values using a received input impact value;

computing an integrated impact map utilizing the set of impact maps and a determined integration algorithm; and determining the one or more drilling recommendations utilizing the set of impact maps, and the input parameters, wherein the one or more drilling recommendations specify at least one of a safe operating zone, an intermediate zone, or a no-go zone;

modifying directions provided to a geo-steering system of a drill bit using the one or more drilling recommendations.

19. The computer program product as recited in claim 18, further comprising:

communicating, using a result transceiver, the one or more drilling recommendations to a borehole system, wherein the borehole system is one or more of a reservoir system, a drilling system, a geo-steering system, a well site system, or a user system.

20. The computer program product as recited in claim 19, further comprising:

alerting a user or the borehole system when the one or more drilling recommendations determines an alert threshold is exceeded.

21. The computer program product as recited in claim 18, furthering comprising:

triggering an alert when the one or more drilling recommendations is not in the safe operating zone or the one or more drilling recommendations is within the no-go zone.

* * * * *